US012741767B2

(12) United States Patent
Font Lletché et al.

(10) Patent No.: US 12,741,767 B2
(45) Date of Patent: Sep. 22, 2026

(54) APPARATUS FOR PLACING ELONGATED PRODUCTS WITH A WIDENED HEAD IN CONTAINERS

(71) Applicant: VOLPAK, S.A.U., Santa Perpetua de Mogoda (ES)

(72) Inventors: Jordi Font Lletché, Caldes de Montbui (ES); Josep Maria Fernández Bermúdez, Caldes de Montbui (ES); Jesús Ruiz Martínez, Terrassa (ES)

(73) Assignee: VOLPAK, S.A.U., Santa Perpetua de Mogoda (ES)

( * ) Notice: Subject to any disclaimer, the term of this patent is extended or adjusted under 35 U.S.C. 154(b) by 0 days.

(21) Appl. No.: 19/112,751

(22) PCT Filed: Sep. 26, 2023

(86) PCT No.: PCT/ES2023/070572

§ 371 (c)(1),
(2) Date: Mar. 18, 2025

(87) PCT Pub. No.: WO2024/069031

PCT Pub. Date: Apr. 4, 2024

(65) Prior Publication Data

US 2026/0097872 A1 Apr. 9, 2026

(30) Foreign Application Priority Data

Sep. 28, 2022 (ES) ..... P202230835

(51) Int. Cl.
*B65B 19/00* (2006.01)
*B65B 19/34* (2006.01)
(Continued)

(52) U.S. Cl.
CPC ..... *B65B 19/34* (2013.01); *B65B 35/12* (2013.01); *B65B 35/20* (2013.01)

(58) Field of Classification Search
CPC ..... B65B 19/34; B65B 35/12; B65B 35/20; B65B 35/38; B65B 35/40; B65B 5/06; B65B 57/20; B65B 63/02
(Continued)

(56) References Cited

U.S. PATENT DOCUMENTS 3,611,674 A * 10/1971 Glickston ..... B65B 9/06 53/550

FOREIGN PATENT DOCUMENTS

CN 107010264 A * 8/2017 ..... B65B 63/026
CN 111086678 A 5/2020
(Continued)

OTHER PUBLICATIONS

International Search Report for International Application No. PCT/ES2023/070572 dated May 7, 2024.
(Continued)

*Primary Examiner* — Jacob A Smith
(74) *Attorney, Agent, or Firm* — Sughrue Mion, PLLC

(57) ABSTRACT

An apparatus for placing elongated products with a widened head in containers, particularly suitable for placing swabs inside containers during the production process. The apparatus has at least one preloading unit which is supplied with the number of products to be placed in the container at one time and which executes a duty cycle that causes the controlled ejection of the number of products supplied, the preloading unit being equipped with a plunger which can move between a loading position and an expelling position and which, when actuated from its loading position to its expelling position, is configured to push and follow the number of products supplied to the preloading unit through an outlet spout of the preloading unit, in a single stroke.

18 Claims, 6 Drawing Sheets

(51) Int. Cl.
*B65B 35/12* (2006.01)
*B65B 35/20* (2006.01)

(58) Field of Classification Search
USPC ..... 53/284.7
See application file for complete search history.

(56) References Cited

FOREIGN PATENT DOCUMENTS

| | | | |
|---|---|---|---|
| CN | 210592681 | U | 5/2020 |
| CN | 210761637 | U | 6/2020 |
| CN | 211468912 | U | 9/2020 |
| JP | 53-44293 | A | 4/1978 |

OTHER PUBLICATIONS

Written Opinion for International Application No. PCT/ES2023/070572 dated May 7, 2024.

* cited by examiner

APPARATUS FOR PLACING ELONGATED PRODUCTS WITH A WIDENED HEAD IN CONTAINERS

This is a National Stage Application of International Application No. PCT/ES2023/070572 filed Sep. 26, 2023, claiming priority based on Spanish Patent Application No. P202230835 filed Sep. 28, 2022.

TECHNICAL FIELD OF THE INVENTION

The invention pertains to the field of packaging operations and in particular to an apparatus for placing elongated products with a widened head in containers. An example of products with these characteristics are the swabs used to take biological samples.

BACKGROUND OF THE INVENTION

A swab to which the invention refers is made up of a stick covered at one end by a material capable of retaining a biological sample. This material can be cotton or of another nature. This covered portion is referred to as the head.

The swabs can be packaged individually or in groups in the same container. A number of products to be packaged can be singular or plural. The term "number of products to be packaged" in the present document comprises the case that the number of products is one or a number greater than one.

It is usual to pack the swabs, which have an oblong shape, that is, longer rather than narrow, in containers that are also oblong. It is also usual for these containers to contain a liquid substance to preserve the properties of the swabs until the container is unsealed to extract and use the swab. It is also usual for the containers to hug the swab or group of swabs to a certain extent in order to reduce material costs for the container and for the liquid substance, which means narrow containers are selected. All this makes it difficult to insert the swabs into the containers when this insertion is to be automated, for example, in a filling station of a line for manufacturing, filling and closing the containers.

In certain cases, this difficulty prevents the swabs from being inserted by gravity, i.e., by letting them drop inside the containers.

In certain cases, this difficulty can cause the operation of introducing the swabs into the containers to represent a bottleneck in the line for manufacturing, filling and closing the containers.

In certain cases, when the number of swabs to be placed in the same container is greater than one, they must be placed at once to avoid, precisely, that this operation represents a bottleneck in the line for manufacturing, filling and closing the containers.

The characteristics of the swabs, especially their heads, is another element that makes handling difficult.

These heads, made up of filiform elements that lead to loose ends, can cause the heads to get hooked between the moving portions of the devices used for handling same.

These heads, when several swabs are grouped, can also produce a sticky effect between the heads that makes it difficult to handle them together.

One purpose of the present invention is an apparatus especially suitable for placing a number of swabs, which can be one or more, at once in a container that overcomes the aforementioned drawbacks.

DESCRIPTION OF THE INVENTION

The apparatus according to the invention is an apparatus according to claim 1, for which embodiments are provided according to the dependent claims.

The apparatus is especially suitable for placing elongated products with a widened head in containers, particularly suitable for placing swabs inside containers in the production process, and comprises at least one preloading unit that is supplied with the number of products to be placed at once in the container and that executes a duty cycle that causes the controlled ejection of the number of products supplied.

In essence, the apparatus is characterised in that the preloading unit is equipped with a plunger movable between a loading position and an ejection position, which offers a loading space when it adopts its loading position and which is configured to push and follow when actuated from its loading position to its ejection position, through an outlet spout of said preloading unit, and in the same stroke, the number of products that is supplied to the preloading unit.

In a variant, the preloading unit has a chamber with an upper inlet for the product to be inserted, for example in an inverted position, i.e., with the head in the lower position in the case of a product in swab format; a receiving bottom, aligned with the inlet in the direction of insertion of the product into the chamber and on which the product will rest when it is inserted into the chamber, the product being in a preloading position; and a movable displacer, in coordination with the plunger, between a preloading position and a loading position and configured to displace, when this displacer is actuated from its preloading position to its loading position, the product that is in the preloading position until arranging same in the loading space offered by the plunger when the plunger adopts its loading position.

Advantageously, the displacer may be configured to seal the upper inlet to the chamber when it adopts its loading position, this seal being able to serve as a retainer for a new number of products to be supplied by gravity to the preloading unit, which will fall by gravity inside their chamber when said displacer adopts its preloading position again.

It is contemplated that the preloading unit may be movable in one direction with a vertical component between a raised position and a lowered position, which gives it the ability to arrange the outlet spout in the mouth of a container when the controlled ejection of the number of products occurs pushed by the plunger.

In a variant, the apparatus is prepared to place a plural number of products, i.e., which exceeds the unit, in the container at once.

According to one embodiment, above the preloading unit there is a feeding ramp provided with one or more tracks that lead to the upper inlet of the chamber of the preloading unit, each one intended to convey and pour a product at once into the aforementioned chamber; the chamber is provided with separating partitions that keep the products poured into the chamber separated, keeping a similar order to that kept in the tracks, said separating partitions not extending through the loading space offered by the plunger when adopting its loading position, and the chamber is also provided with means for the gathering of products in the loading space, sufficient gathering so that the number of products gathered can be pushed out of the preloading unit in the same stroke of the plunger.

This makes it possible to operate in a controlled manner on the products and gather them just moments before being expelled. Among other aspects, it is avoided, for example, that they overlap or cross each other, hindering their automatic handling or affecting their movement due to interference with the mobile portions of the device.

In a variant, the loading space is an essentially orthohedral space superiorly defined by the head of the plunger; inferiorly by an outlet wall with the outlet spout; and laterally by a first pair of facing walls that are formed by the movable displacer when it adopts its loading position and a front wall, optionally with transparent properties to be able to monitor the inside of the loading space from the outside, as well as by a second pair of facing walls.

It is of interest that said second pair of facing walls is movable in a direction essentially transversal to the chamber, so that they can be actuated in the direction of mutual approach and in the direction of mutual distancing to adopt respective loading and gathering positions, this second pair of facing walls thus making up the means for the gathering of the products in the aforementioned loading space.

According to an aspect of interest, in a variant of the apparatus, the receiving bottom has a seat or a series of seats equal in number to that of the tracks of the feeding ramp, on which or on each of which a product of the number of products inserted into the chamber is able to rest stably and in a controlled manner.

Preferably, this seat or seats extend, in a sort of grooves, up to the loading space, then the products will continue to rest stable even when they are moved inside the chamber.

Preferably, the seat or seats are wedge-shaped, thus producing a self-centring effect.

In a particular variant, the number of seats being equal to three, the central seat is arranged in the receiving bottom at a level below the two lateral seats, so that in the event of products in swab format, the swabs can be gathered to take up less space by avoiding that their heads are all on the same level.

It is also contemplated that the displacer may have on its upper face a seat or a series of seats equal in number to that of the tracks of the feeding ramp, on which or on each of which a product of the number of products to be inserted into the chamber of the preloading unit is able to rest stably when the displacer adopts its loading position, blocking the upper inlet to said chamber.

Preferably, the seat or seats of the displacer are wedge-shaped to display a self-centring effect.

It is envisaged that in the feeding ramp, in each track, there may be a stop that can be actuated individually or jointly with the other stops, if any, between a retention position, capable of retaining a product during its descent down the track while there is another product below resting on the displacer and while there is another product or a plural number of products to be placed in the container at once in the loading space; and a release position that does not hinder a product during its descent down the track. The coordinated actuation of the stop or stops, the displacer and the plunger, allows a step-by-step execution of the apparatus and the feeding thereto of a succession of products, individually or in groups.

Taking advantage of the nature of the products in swab format, the heads of which are deformable, in a variant of the invention the outlet spout of the preloading unit is provided to be exchangeable, in order to be able to select an outlet spout the passage cross section of which is less than the size of the head of the product, or of the gathering of products, to be placed in the container at once. The correct selection of the spout will allow it to retain the product or the gathering of products in the loading space so that they will only come out of the loading space when they are pushed by the plunger, which will force their expulsion, momentarily deforming the head or heads when passing through the outlet spout to later restore their natural shape.

BRIEF DESCRIPTION OF THE DRAWINGS

In the following drawings, simple schematics are used to conceptually illustrate an aspect of the invention and an apparatus is shown that exemplifies an embodiment of the invention, specifically an apparatus prepared to place three swabs in each one of two containers at once. In these drawings:

FIG. 5 shows the complete apparatus at a moment which is equivalent to that of FIG. 1 of a duty cycle;

DETAILED DESCRIPTION OF THE INVENTION

Figure 1:
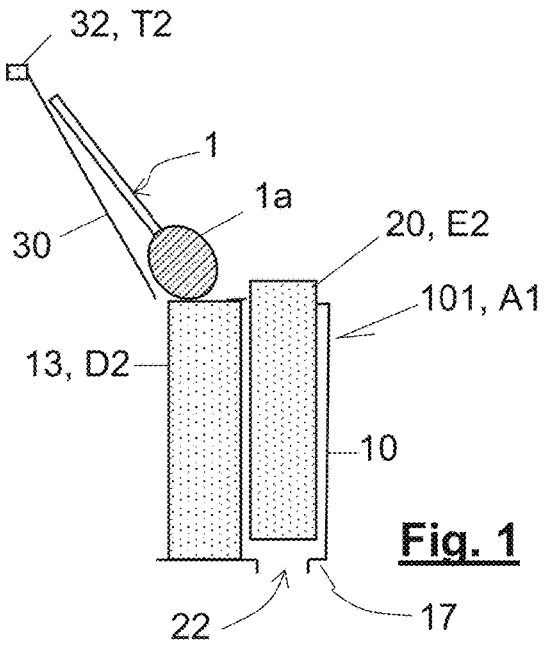
FIGS. 1 to 4 schematically and sequentially show a duty cycle of a preloading unit of an apparatus according to the invention.

The device that is conceived is suitable for placing elongated products with a widened head in containers, the products being swabs. The apparatus is intended to be placed in a work station of an automated line for manufacturing, filling and closing containers. In this work station, a container is arranged open under the apparatus. An important aspect of the apparatus is that it comprises a preloading unit that is supplied with the number of products to be placed at once in the container and that executes a duty cycle that causes the controlled ejection of the number of products supplied.

A duty cycle of a preloading unit 101 has been schematically illustrated in FIGS. 1 to 4, in which the number of swabs to be placed at once in the container is only one.

The preloading unit 101 has a chamber 10 with an upper inlet 11 and an outlet spout 22. The upper inlet 11 and the outlet spout 22 are not aligned in the direction of insertion of the swab 1 into the chamber 10.

The preloading unit 101 is equipped with a plunger 20 movable between a loading position E1 and an ejection position E2, which offers a loading space 21 when same adopts its loading position E1.

The plunger 20 is configured to be able to push and follow when actuated from its loading position E1 to its ejection position E2, through the outlet spout 22, the swab 1 which is first inserted into the chamber 10 and then arranged in the loading space 21 in two sequential steps of the duty cycle. The movement of the plunger 20 is indicated in the diagrams by the vertical filled arrows.

The chamber 10 is provided with a movable displacer 13, in coordination with the plunger 20, between a preloading position D1 and a loading position D2 which, when actuated from its preloading position D1 to its loading position D2, ensures that a swab 1 that has just been inserted into the chamber 10 is moved from an initial preloading position until it is arranged in the loading space 21 offered by the plunger 20 when said plunger adopts its loading position E1. The movement of the displacer 13 is indicated in the diagrams by the horizontal filled arrows.

Figure 4:
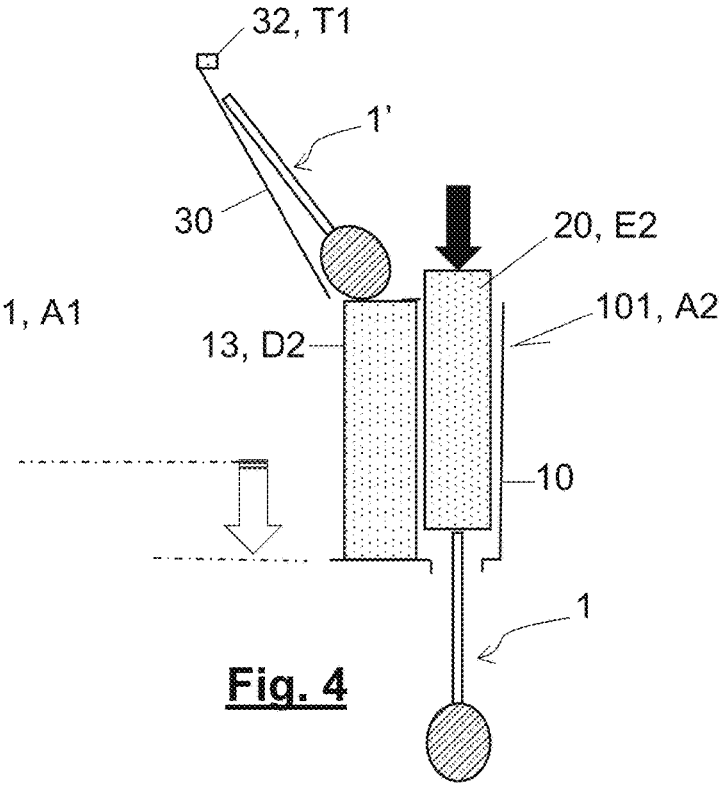

Finally, the entire preloading unit 101 is movably assembled on the chassis of the apparatus in one direction with a vertical component between a raised position A1 and a lowered position A2, which gives it the ability to arrange the outlet spout 22 at the mouth of a container 4 when the controlled ejection of the swab 1 through the outlet spout 22 occurs. This movement of the preloading unit 101 is shown in FIG. 4 of the diagrams with the vertical hollow arrow.

Thus, a duty cycle can be started by the moving portions of the preloading unit 101 adopting the position shown in FIG. 1. It should be noted that the displacer 13 adopts its loading position D2, blocking the upper inlet 11 of the chamber 10. As will be explained in greater detail later, the upper face of the displacer 13 may be configured so that the swab 1 to be placed in the container when the starting duty cycle is executed rests on same stably by its head 1*a*.

Although the plunger 20 has been shown in its ejection position E2, other intermediate positions or the loading position E1 could be feasible.

Figure 2:
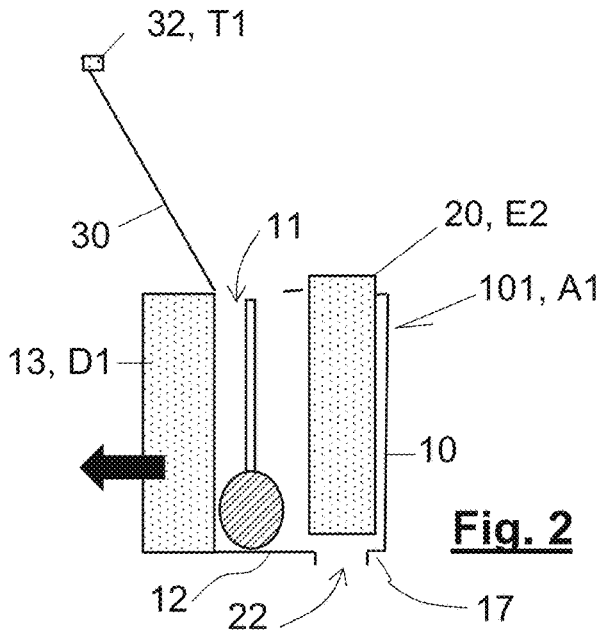

The duty cycle will continue with the actuation of the displacer 13 to its preloading position D1, unblocking the upper inlet 11 of the chamber 10 and allowing the unloading by gravity of the swab 1 inside same, as illustrated in FIG. 2. As explained in greater detail later, a receiving bottom 12 of the chamber 10 can be specially configured so that the swab 1 rests on top of same stably by its head 1*a*. Although the plunger 20 has been shown in its ejection position E2, other intermediate positions or the loading position E1 could be feasible.

Figure 3:
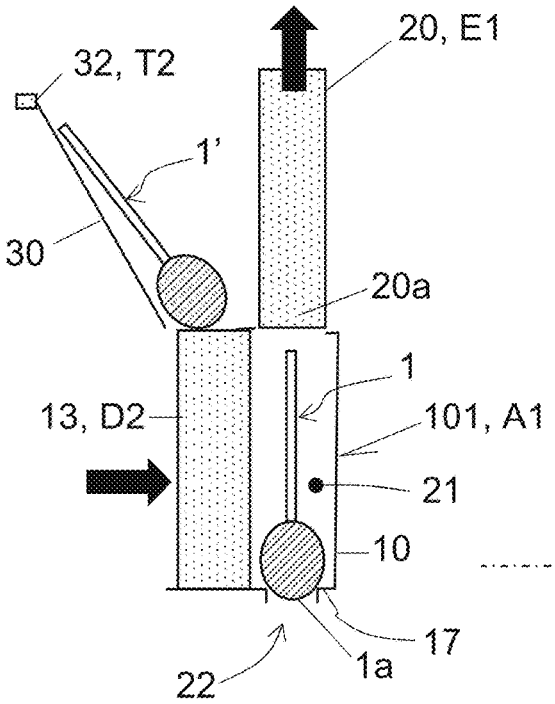

The duty cycle will continue with the actuation of the displacer 13 to its loading position D2, dragging the swab 1 with it until it is placed in the loading space 21, under the head 20*a* of the plunger 20, as illustrated in FIG. 3. In this case, it is essential that the plunger 20 adopts its loading position E1.

Consequently, from the beginning of the cycle the plunger 20 must have been actuated to its loading position E1 if it had previously assumed its ejection position E2.

By the displacer 13 adopting its loading position D2 again, a new swab 1' can be arranged on standby on the displacer 13 for the execution of a next duty cycle.

Likewise, as will also be discussed in more detail later, the dimensions of the outlet spout 22 are preferably selected so that its passage cross section is smaller than the size of the head 1*a* of the swab 1. In this way, the swab 1 is retained in the loading space 21 without the need to use a movable gate or the like to prevent/enable the exit by gravity of the swab 1 from the preloading unit 101.

This variant takes advantage of the fact that the head 1*a* of the swab 1, due to its compressible nature, may be elastically deformed when the swab 1 is pushed by the plunger 20 in the next step of the duty cycle, forcing said head 1*a* to pass through the outlet spout 22.

This next step is represented in FIG. 4, which entails the actuation of the plunger 20 to its ejection position E2 and therefore the controlled ejection of the swab 1 out of the chamber 10 and of the preloading unit 101. Simultaneously, partially simultaneously or in sequence, the preloading unit 101 is provided to be actuated to lower it from a raised position A1 to a lowered position A2 in order to place the outlet spout 22 at the mouth of the container, not represented in the diagrams.

Another feature illustrated in the diagrams of FIGS. 1 to 4 is the ramp 30 for feeding the swabs 1, 1' to the chamber 10 of the preloading unit 101. The ramp 30 is provided with a stop 32 between a retention position T1 and a release position T2. During the execution of a duty cycle n, when the stop 32 adopts its retention position T1, it will be able to retain a swab (not shown) during its descent down the ramp 30 on which the duty cycle n+2 will be executed, while there is another swab below resting on the displacer 13 when same adopts its loading position D2 and on which the duty cycle n+1 will be executed and while the swab is in the loading space 21 on which the duty cycle n in progress is executed.

FIGS. 5 to 10 show an apparatus 100 that exemplifies an embodiment of the invention, specifically an apparatus 100 prepared to place in two containers, for example, in envelope-type format containers, a number of three swabs 1*a*, 1*b*, 1*c* in each container at once. The apparatus 100 is especially well suited for duplex machines for forming, filling and closing containers, in which containers are moved in pairs from one work station to the next on the machine.

For this purpose, the apparatus 100 has two preloading units 101, 102. The apparatus 100 is shown complete in FIG. 5, having removed some portions of the preloading unit 101, which is arranged to the right of the image, in order to be able to view its interior.

Figure 5:
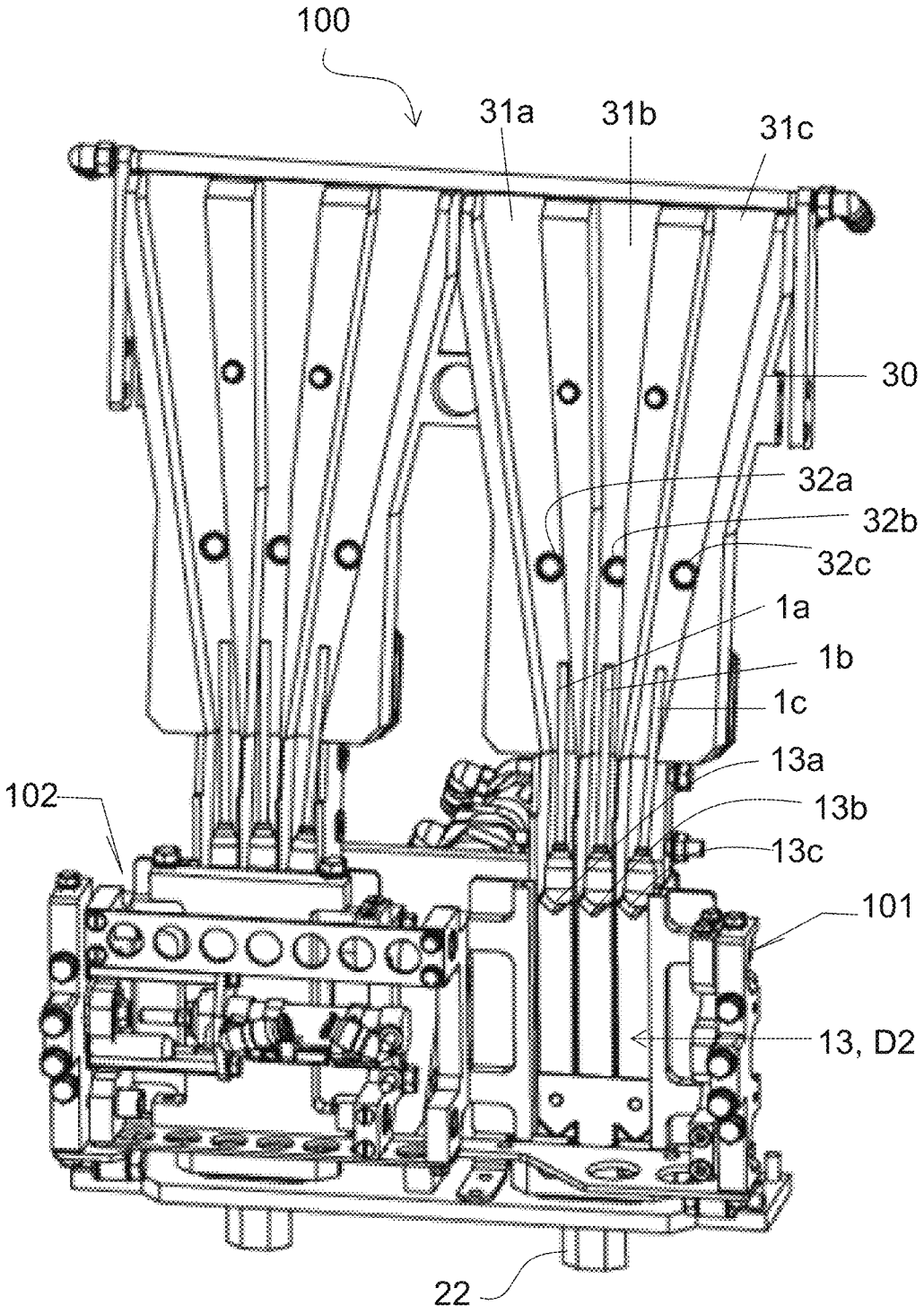
FIG. 5 onwards show the apparatus that exemplifies the invention. About.

In this FIG. 5 the visible moving portions of the preloading unit 101 adopt the position that is equivalent to that of FIG. 1 in the diagrams, of the start of the duty cycle, with the displacer 13 adopting its loading position D2. The three swabs 1*a*, 1*b*, 1*c* are supplied via the feeding ramp 30, in this case via respective tracks 31*a*, 31*b* and 31*c* with which the ramp 30 has been provided.

In this case, in each track 31*a*, 31*b*, 31*c* of the feeding ramp 30, a respective stop 32*a*, 32*b*, 32*c* will operate able to be individually or jointly actuated with the other stops between their retention and release positions. Each track conveys a corresponding swab until it rests by its head on the upper face of the displacer 13. The profile of said upper face is not flat and defines seats 13*a*, 13*b*, 13*c* in a number equal to that of the tracks 31*a*, 31*b*, 31*c* of the feeding ramp 30, that is, three in number in the example, which contributes to the support stability of the swabs when they fall on the displacer 13. Preferably, each seat is wedge-shaped or the like.

Figure 6A:
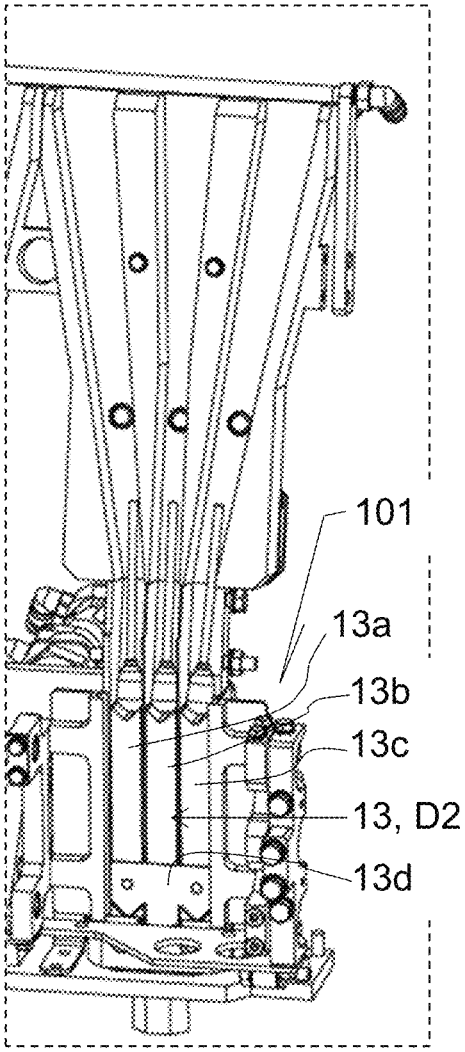
FIGS. 6*a* and 6*b* show a sequence of the apparatus between the moments which are equivalent to FIGS. 1 and 2 of a duty cycle.
Figure 6B:
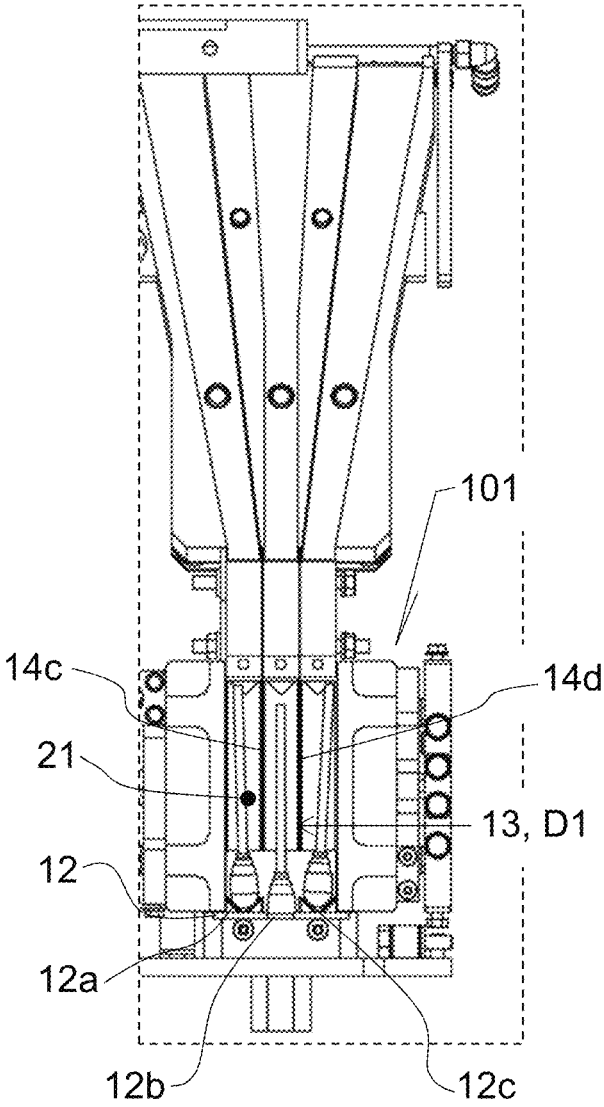

FIGS. 6*a* and 6*b* focus on the preloading unit 101 of the apparatus 100 to show the transit of the displacer 13 from its loading position D2 (see FIG. 6*a*) to its preloading position D1 (see FIG. 6*b*) which causes the three swabs 1*a*, 1*b*, 1*c* to fall inside the chamber of the preloading unit 101.

FIGS. 6*a* and 6*b* allow to show how the profile of the receiving bottom 12 of the chamber is not flat and that it also defines seats 12*a*, 12*b* (partially hidden), 12*c* in a number equal to that of the swabs to be received, i.e., three in number, which contribute to the support stability of the swabs when they fall on the receiving bottom 12.

Preferably, each seat is wedge-shaped or similar and determines a kind of slot that extends in the direction of and reaches the loading space 21, inside of which the head of the associated swab will slide when the displacer 13 is actuated from its preloading position D1 to its loading position D2 in the next step of the duty cycle.

FIGS. 6*a* and 6*b* show a first aspect of the apparatus 100 not represented in the diagrams of FIGS. 1 to 5.

Specifically, we are referring to the fact that the chamber of the preloading unit 101 is provided with separating partitions 14*c*, 14*d* that keep the swabs inserted into the chamber separated, keeping a similar order to that kept inside the tracks 31*a*, 31*b*, 31*c*. However, these partitions 14*c*, 14*d* do not manage to extend through the loading space 21 offered by the plunger 20 when it adopts its loading position E1. This will make it possible to gather the swabs 1*a*, 1*b*, 1*c* in this loading space 21 in order to be able to place them in narrower envelopes, with a width dimension less than the width occupied by the three swabs when inserted into the preloading unit 101 and even less. in the case of arranging the three swabs with their sticks parallel and with their heads flush or at the same level.

It should be noted that this characteristic means that the displacer 13 is provided with two slots in coincidence with the partitions 14*c*, 14*d*. The partitions 14*c*, 14*d* being fixed, they will go from being visible to being hidden, embedded or submerged in the displacer 13 when the latter passes from its preloading position D1 to its loading position D2. It is for this reason that the displacer 13 that is exemplified has a shape in which three vertical fingers 13*a*, 13*b*, 13*c* and a lower portion 13*d* can be distinguished without discontinuity at the level of the heads of the swabs.

Figure 7A:
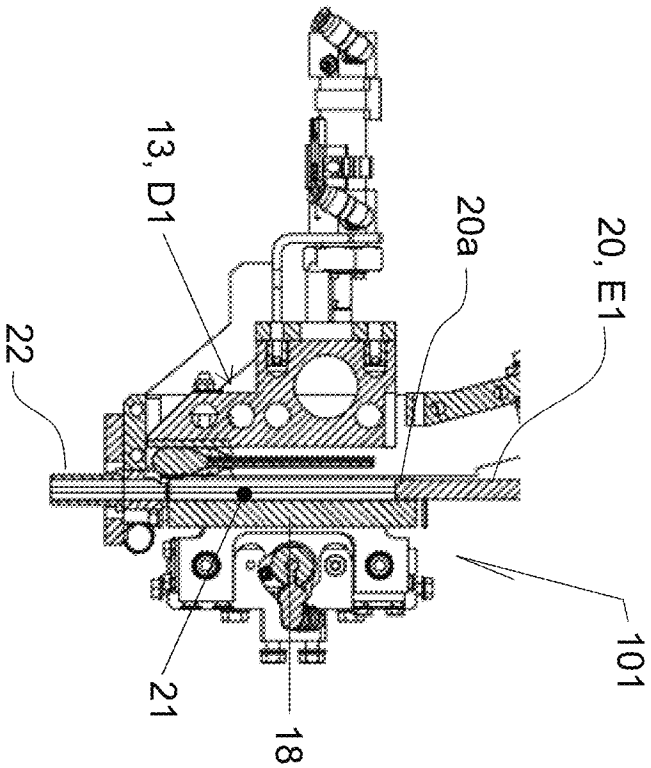
FIGS. 7*a* and 7*b* show a sequence of the apparatus between the moments which are equivalent to FIGS. 2 and 3 of a duty cycle.
Figure 7B:
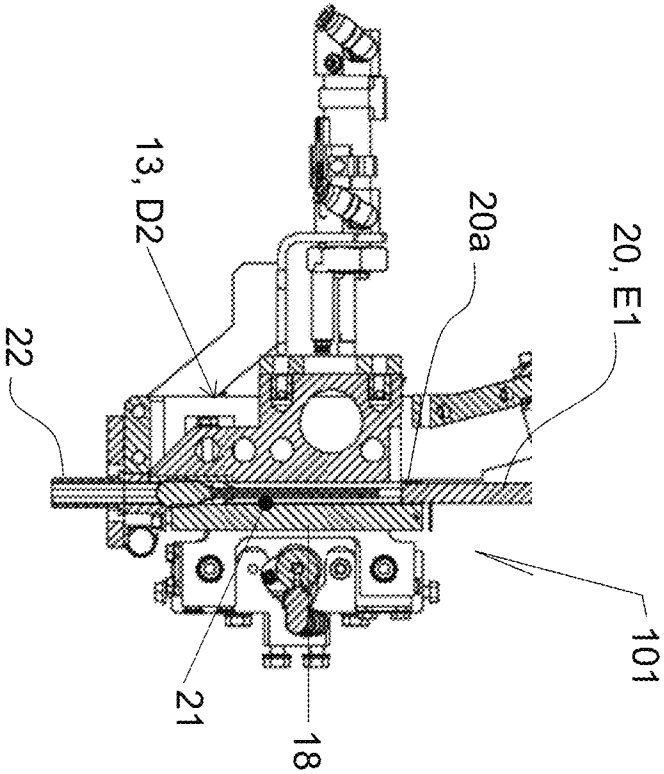

FIGS. 7*a* and 7*b* focus precisely on showing the transit of the displacer 13 from its preloading position D1 (see FIG. 7*a*) to its loading position D2 (see FIG. 7*b*) for which respective cross sectional views of the preloading unit 101 are shown.

Figure 8A:
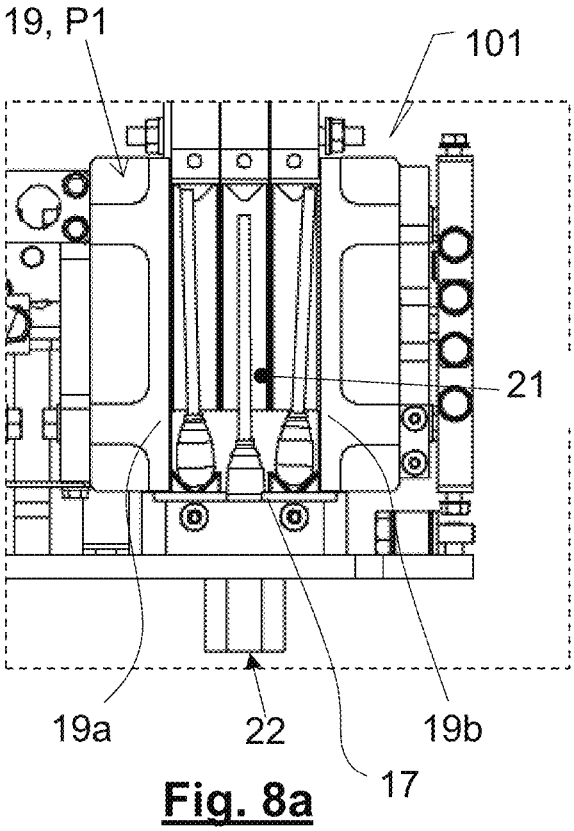
FIGS. 8*a* and 8*b* show a sequence of the apparatus when proceeding to gather the three swabs that must be placed at once in a container.
Figure 8B:
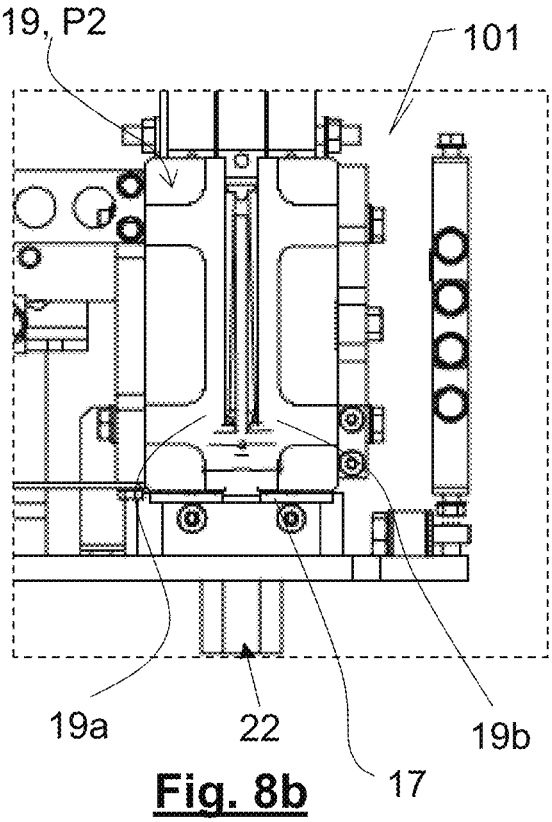

FIGS. 8*a* and 8*b* show new aspects of the apparatus 100 not shown in the diagrams of FIGS. 1 to 5.

The duty cycle that the apparatus 100 executes comprises indeed carrying out a step prior to actuating the plunger 20 from its loading position E1 to its ejection position E2. This prior step consists of gathering the swabs 1*a*, 1*b*, 1*c*, an operation to which reference had been briefly made above.

For this purpose, the chamber of the preloading unit 101 has means for the gathering 19 of the three swabs in the loading space 21. In addition to helping to place the swabs in a narrow container, this gathering also contributes in a practical manner to greater ejection control and to the fact that the formed gathering can be pushed out of the preloading unit 101 in the same stroke of the plunger 20.

In the example, the loading space 21 is an essentially orthohedral space defined: above, by the head 20*a* of the plunger (see FIGS. 7*a* and 7*b*); below by an outlet wall 17 with the outlet spout 22; laterally, by a first pair of facing walls that are formed by the displacer 13 when it adopts its loading position D2 and a monitoring front wall 1S, preferably having transparent properties, and by a second pair of facing walls 19*a*, 19*b*.

In the exemplary apparatus 100, this second pair of facing walls 19*a*, 19*b* are movable in a direction essentially transversal to the chamber, so that they can be actuated in the direction of mutual approach and in the direction of mutual distancing to adopt respective loading P1 (see FIG. 8*a*) and gathering P2 positions (see Figure Sb), this second pair of facing walls 19*a*, 19*b* thus making up the means for the gathering 19 of the swabs in the loading space 21.

At this point, it should be noted that the exit wall 17, a seamless extension of the reception wall 12 and therefore presenting the three seats 12*a*, 12*b* and 12*c*, which may or may not be wedge-shaped, is configured to position the central swab 1*b* slightly at a level below the swabs 1*a* and 1*c*. For this, the central seat 12*b* is arranged at a level below the two lateral seats 12*a*, 12*c*. This particularity allows the gathering of the swabs without altering the parallel orientation of their sticks too much, the heads of the swabs being able to slightly ride on each side of the central swab 1*b*, in a way that approximates FIG. 10.

Figure 9:
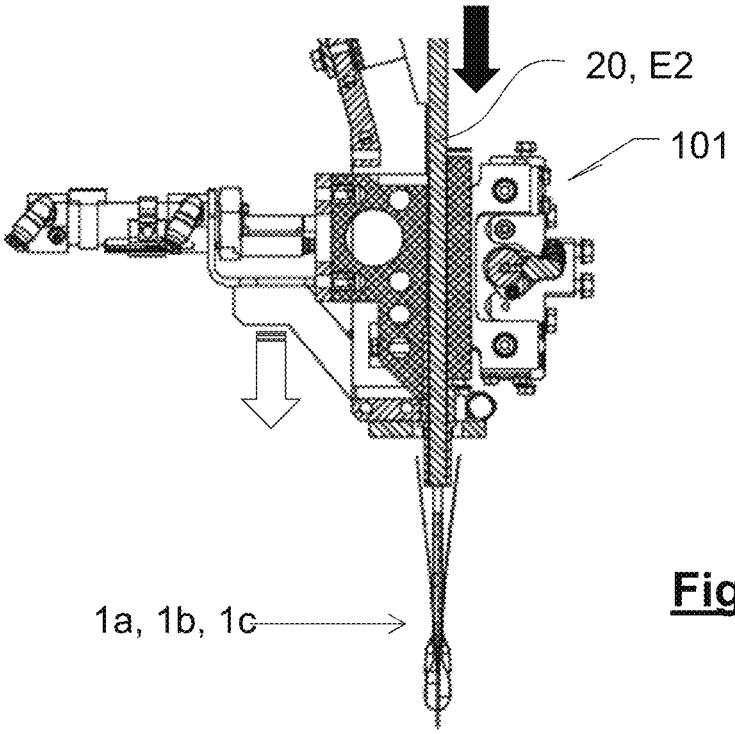
FIG. 9 shows the apparatus at a moment equivalent to that of FIG. 4 of a duty cycle.

FIG. 9, comes to show the preloading unit 101 of the apparatus 100 in the position of the duty cycle that the diagram of FIG. 4 schematically illustrated, i.e., with the plunger moved to its ejection position E2, pushing the three swabs, previously gathered, out of the chamber in the same stroke of the plunger 20.

FIG. 9, similar to FIG. 4, the vertical arrows, one filled and the other hollow, indicate the movement of the plunger 20 and the downward movement of the preloading unit 101, up to its lowered position, respectively.

Figure 10:
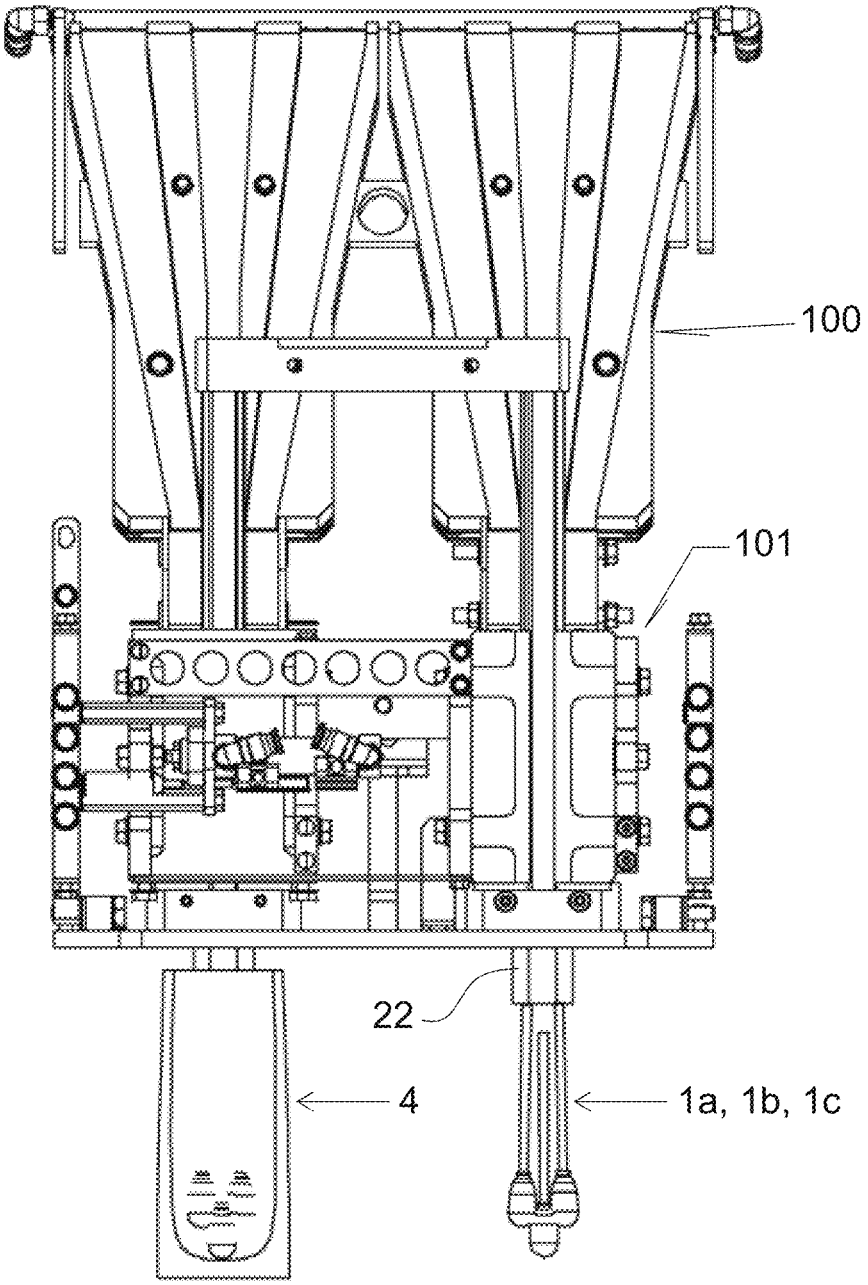
FIG. 10 shows the complete apparatus at the moment when the two groups of swabs are each placed in a respective container.

Thus, the two preloading units 100 and 101 of the apparatus 100, which is once again shown in its entirety in FIG. 10, are arranged so that each outlet spout 22 is located at the mouth of a respective container 4.

In FIG. 10, only the container 4 has been represented in which the swabs that are expelled by the preloading unit 100 are placed, in order to be able to show the arrangement that the swabs adopt inside a container, arrangement that is shown in the swabs expelled by the preloading unit 101.

The invention claimed is:

1. An apparatus for placing a number of products, each having a widened head, in a container, the apparatus comprising at least one preloading unit configured to be supplied with the number of products to be placed at once in the container and configured to execute a duty cycle that causes the controlled ejection of the number of products supplied, wherein the preloading unit is equipped with a plunger movable between a loading position and an ejection position, and which offers a loading space in the preloading unit when the plunger adopts the loading position, the plunger configured to, when actuated, push and follow from the loading position to the ejection position the number of products that is supplied to the preloading unit in the same stroke through an outlet spout provided in said preloading unit;

wherein the preloading unit has a chamber with an upper inlet for inserting the number of products therein; a receiving bottom, aligned with the upper inlet in the direction of insertion of the number of products into the chamber and on which the number of products rests when inserted into the chamber, the number of products being in a preloading position; and a displacer that is moveable, in coordination with the plunger, between a preloading position of the displacer and a loading position of the displacer and configured to move, when this displacer is actuated from the preloading position of the displacer to the loading position of the displacer, the number of products that is in the preloading position until the number of products is arranged in the loading space offered by the plunger when the plunger adopts the loading position.

2. The apparatus according to claim 1, wherein the displacer blocks the upper inlet to the chamber when the displacer adopts the loading position of the displacer, this blocking configured to serve as a retainer for a new number of products to be supplied by gravity to the preloading unit, which will fall due to the effect of gravity inside the chamber when the displacer adopts the preloading position of the displacer again.

3. The apparatus according to claim 2, wherein the displacer has a seat or a series of seats on an upper face of the displacer equal in number to that of tracks of the feeding ramp, on which or on each of which a product of the number of products to be inserted into the chamber of the preloading unit may rest when the displacer adopts the loading position of the displacer blocking the upper inlet to said chamber.

4. The apparatus according to claim 3, wherein the seat or seats of the displacer are wedge-shaped.

5. The apparatus according to claim 1, wherein the chamber is further provided with means for gathering of products in the loading space, sufficient gathering so that the number of products gathered can be pushed out of the preloading unit in the same stroke of the plunger.

6. The apparatus according to claim 5, wherein:

the loading space is a rectangular parallelepiped space determined as follows: above, by a head of the plunger; below by an outlet wall with the outlet spout; laterally, by a first pair of facing walls that are formed by the displacer when the displacer adopts the loading position of the displacer and a front monitoring wall, and by a second pair of facing walls, and said second pair of facing walls are movable in a direction essentially transversal to the chamber, so that said second pair of facing walls can be actuated in a direction of mutual approach and in a direction of mutual distancing to adopt respective loading and gathering positions, this second pair of facing walls thus making up the means for the gathering of the products in the loading space.

7. The apparatus according to claim 6, wherein the monitoring front wall is an at least partially transparent wall.

8. The apparatus according to claim 1, wherein the number of products is a plural number of products and wherein the apparatus is configured to place the plural number of products in the container at once; and wherein:

above the preloading unit there is a feeding ramp provided with tracks that lead to the upper inlet of the chamber of the preloading unit, each one configured to convey and pour the plural number of products into the aforementioned chamber at once, the chamber is provided with separating partitions that keep the plural number of products poured into the chamber separated, keeping a similar order to that kept in the tracks, said separating partitions not extending through the loading space offered by the plunger when adopting the loading position, and the chamber is also provided with means for the gathering of the plural number of products in the loading space, sufficient gathering so that the plural number of products gathered can be pushed out of the preloading unit in the same stroke of the plunger.

9. The apparatus according to claim 8, wherein a stop is arranged on each track of the feeding ramp, which can be actuated individually or jointly with the other stops if there are any between a retention position, capable of retaining a product during descent down the track while there is another product below resting on the displacer, when the displacer adopts loading position of the displacer blocking the upper inlet to the chamber and while there is another product or a plural number of products in the loading space to be placed in the container at once; and a release position that does not hinder a product during descent down the track.

10. The apparatus according to claim 1, wherein the receiving bottom has a seat or a series of seats equal in number to that of tracks of a feeding ramp, on which or on each of which one product of the number of products inserted into the chamber is able to rest.

11. The apparatus according to claim 10, wherein the seat or seats extend, in a sort of slots, up to the loading space.

12. The apparatus according to claim 10, wherein the seat or seats are wedge-shaped.

13. The apparatus according to claim 10, wherein the number of seats are equal to three, arranged as two lateral seats and a central seat, the central seat is arranged in the receiving bottom at a level below the two lateral seats.

14. The apparatus according to claim 1, wherein the elongated products with a widened head are swabs.

15. An apparatus for placing a number of products, each having a widened head, in a container, the apparatus comprising at least one preloading unit configured to be supplied with the number of products to be placed at once in the container and configured to execute a duty cycle that causes the controlled ejection of the number of products supplied, wherein the preloading unit is equipped with a plunger movable between a loading position and an ejection position, and which offers a loading space in the preloading unit when the plunger adopts the loading position, the plunger configured to, when actuated, push and follow from the loading position to the ejection position the number of products that is supplied to the preloading unit in the same stroke through an outlet spout provided in said preloading unit;

wherein the preloading unit is movable in a direction with a vertical component between a raised position and a lowered position which confers same the ability to arrange the outlet spout in the mouth of a container when the controlled ejection of the number of products pushed by the plunger occurs.

16. The apparatus according to claim 15, wherein the elongated products with a widened head are swabs.

17. An apparatus for placing a number of products, each having a widened head, in a container, the apparatus comprising at least one preloading unit configured to be supplied with the number of products to be placed at once in the container and configured to execute a duty cycle that causes the controlled ejection of the number of products supplied, wherein the preloading unit is equipped with a plunger movable between a loading position and an ejection position, and which offers a loading space in the preloading unit when the plunger adopts the loading position, the plunger configured to, when actuated, push and follow from the loading position to the ejection position the number of products that is supplied to the preloading unit in the same stroke through an outlet spout provided in said preloading unit;

wherein the outlet spout of the preloading unit is exchangeable, in order to be able to select an outlet spout the passage cross section of which is less than a size of the head of the number of to be placed in the container at once.

18. The apparatus according to claim 17, wherein the elongated products with a widened head are swabs.

* * * * *